US008858013B2

(12) United States Patent
Attey et al.

(10) Patent No.: US 8,858,013 B2
(45) Date of Patent: Oct. 14, 2014

(54) LOW HEAT TRANSFER MAGNETIC SHELF ATTACHMENT

(75) Inventors: Joel Attey, Belleville, IL (US); Mark Miller, Saint Peters, MO (US); Timothy D. Anderson, St. Louis, MO (US); Ken Nguyen, St. Louis, MO (US)

(73) Assignee: Hussmann Corporation, Bridgeton, MO (US)

( * ) Notice: Subject to any disclaimer, the term of this patent is extended or adjusted under 35 U.S.C. 154(b) by 543 days.

(21) Appl. No.: 13/097,604

(22) Filed: Apr. 29, 2011

(65) Prior Publication Data

US 2012/0274189 A1 Nov. 1, 2012

(51) Int. Cl.

| | |
|---|---|
| ***F25D 27/00*** | (2006.01) |
| ***A47F 11/10*** | (2006.01) |
| ***F21S 4/00*** | (2006.01) |
| ***A47F 3/00*** | (2006.01) |
| ***F21V 21/096*** | (2006.01) |
| *F21V 23/06* | (2006.01) |
| *F21V 31/00* | (2006.01) |
| *F21V 15/015* | (2006.01) |
| *F21Y 103/00* | (2006.01) |
| *F21W 131/405* | (2006.01) |
| *F21Y 101/02* | (2006.01) |
| *F21W 131/305* | (2006.01) |
| *F21S 2/00* | (2006.01) |

(52) U.S. Cl.

CPC ..... *A47F 11/10* (2013.01); *F21V 23/06* (2013.01); *F21V 31/005* (2013.01); *F21V 15/015* (2013.01); *F21S 4/003* (2013.01); *F21Y 2103/003* (2013.01); *F21W 2131/405* (2013.01); *F21Y 2101/02* (2013.01); *A47F 3/001* (2013.01); *F21W 2131/305* (2013.01); *F21V 21/096* (2013.01); *F21S 2/00* (2013.01)

USPC ..... 362/126; 362/125; 362/133; 362/92; 362/93; 362/94

(58) Field of Classification Search

USPC ..... 362/125, 126, 133, 92–94

See application file for complete search history.

(56) References Cited

U.S. PATENT DOCUMENTS

| | | | |
|---|---|---|---|
| 3,917,940 | A | 11/1975 | Duddy |
| 4,422,137 | A | 12/1983 | Watts |
| 4,454,569 | A | 6/1984 | Maguire |
| 4,535,395 | A | 8/1985 | Prester |
| 5,154,509 | A | 10/1992 | Wulfman et al. |
| 5,457,614 | A | 10/1995 | Duty |
| 6,855,890 | B1 | 2/2005 | Vasichek |
| 7,338,189 | B2 | 3/2008 | Kovacik et al. |
| 7,549,779 | B2 | 6/2009 | Genenbacher |
| 7,575,347 | B1 | 8/2009 | Daly |

(Continued)

FOREIGN PATENT DOCUMENTS

| | | |
|---|---|---|
| EP | 1733653 | 12/2006 |

*Primary Examiner* — William Carter

(74) *Attorney, Agent, or Firm* — Michael Best & Friedrich LLP

(57) ABSTRACT

A merchandiser including a case defining a product display area and having case structure. The merchandiser also includes a light assembly. The light assembly has a light housing and a light source coupled to the light housing to direct light generally toward the product display area. The merchandiser further includes an attachment mechanism having a magnet housing and a magnet substantially enclosed by the magnet housing. The attachment mechanism is coupled to the light housing opposite the light source to attach the light assembly to the case structure.

20 Claims, 6 Drawing Sheets

(56) References Cited

U.S. PATENT DOCUMENTS

| | | | | |
|---|---|---|---|---|
| 7,726,852 | B2 | 6/2010 | Sanoner et al. | |
| 7,806,569 | B2 | 10/2010 | Sanroma et al. | |
| 2006/0152914 | A1 * | 7/2006 | Yokota | 362/92 |
| 2008/0158858 | A1 * | 7/2008 | Madireddi et al. | 362/92 |
| 2009/0279298 | A1 | 11/2009 | Mier-Langner et al. | |
| 2010/0188862 | A1 | 7/2010 | Muhs | |
| 2010/0290240 | A1 * | 11/2010 | Genenbacher | 362/398 |

* cited by examiner

LOW HEAT TRANSFER MAGNETIC SHELF ATTACHMENT

BACKGROUND

The present invention relates to a magnetic attachment for a light assembly, and more particularly, to a magnetic shelf attachment for a light assembly in a merchandiser.

In conventional practice, commercial businesses such as supermarkets and convenience stores are equipped with refrigerated merchandisers. These refrigerated merchandisers may be open or provided with doors and are used for presenting perishable food or beverages to customers while maintaining the fresh food or beverages in a refrigerated environment. Typically, these refrigerated merchandisers include a light source to illuminate the product display area for better marketing of the food product and for higher visibility to the customers.

Conventional refrigerated merchandisers typically include a fluorescent light source to illuminate the product display area. Some refrigerated merchandisers include fluorescent light sources coupled to a canopy of the refrigerated merchandiser to direct light generally downward onto the food product in the product display area. These refrigerated merchandisers also may include fluorescent light sources attached to shelves or other areas of the product display area. Generally, the fluorescent light sources used in conventional refrigerated merchandisers are relatively large, and reduce the amount of space in the refrigerated merchandiser that can be allocated to displaying food product.

The effectiveness of fluorescent light sources is dependent on the temperature of the application where the fluorescent light sources are used. In colder temperature environments, the fluorescent light source has less light output than a fluorescent light source in warmer temperature environments.

Other refrigerated merchandisers include light emitting diode (LED) light sources to illuminate the product display area. These LED light sources generally operate at a relatively high current (e.g., 300 mA), which produces a substantial amount of heat that can adversely affect the temperature of the food product in the product display area.

Replacing light sources in existing merchandisers can be relatively complex and inefficient. Generally, merchandisers must be modified to accommodate a replacement light source. Often, additional holes are needed in the existing canopy and/or shelves to adapt the existing merchandiser to the replacement light source, which can increase the complexity of the assembly process and the time needed to replace the light source.

SUMMARY

In some constructions, the invention provides a merchandiser including a case that defines a product display area and that has case structure. The merchandiser also includes a light assembly. The light assembly has a light housing and a light source coupled to the light housing to direct light generally toward the product display area. The merchandiser further includes an attachment mechanism that has a magnet housing and a magnet substantially enclosed by the magnet housing. The attachment mechanism is coupled to the light housing opposite the light source to attach the light assembly to the case structure.

In another construction, the invention provides a light assembly for a merchandiser including case structure. The light assembly includes a light housing and a light source coupled to the light housing. The light assembly further includes an attachment mechanism that has a magnet housing and a magnet substantially enclosed by the magnet housing. The attachment mechanism is coupled to the light housing opposite the light source, and the attachment mechanism is configured to couple to the case structure.

In yet another construction, the invention provides a light assembly for a merchandiser including case structure. The light assembly includes a light housing and an LED light source coupled to the light housing. The light assembly further includes an attachment mechanism that has a non-conductive housing defining an aperture and a magnet partially exposed by the aperture. The attachment mechanism is coupled to the light housing opposite the LED light source, and the attachment mechanism is configured to couple to the case structure such that the magnet is spaced apart from the case structure.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings.

Figure 1:
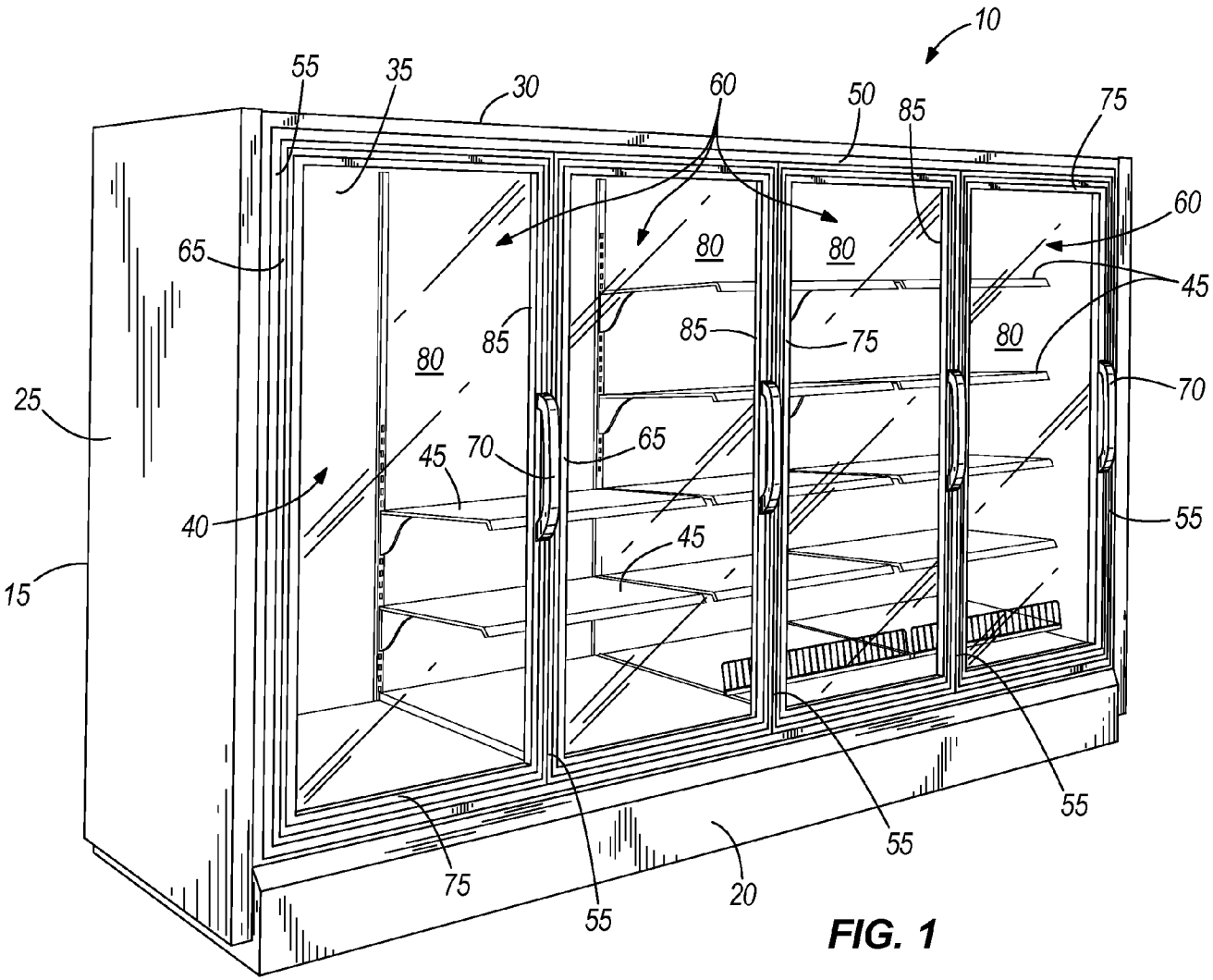
FIG. 1 is a perspective view of a refrigerated merchandiser including a light assembly embodying the present invention.
Figure 2:
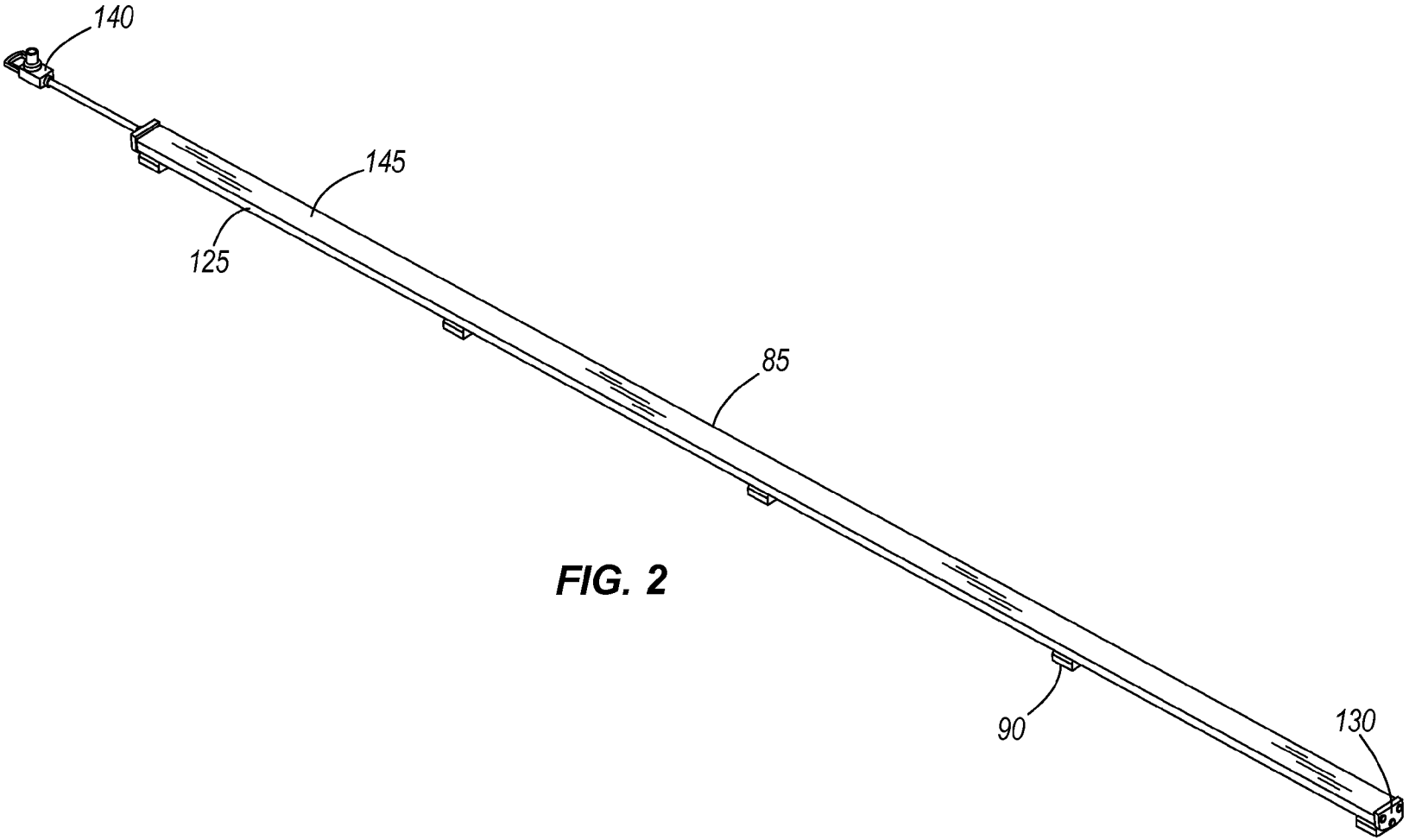
FIG. 2 is a perspective view of the light assembly including a light housing and a light source.
Figure 3:
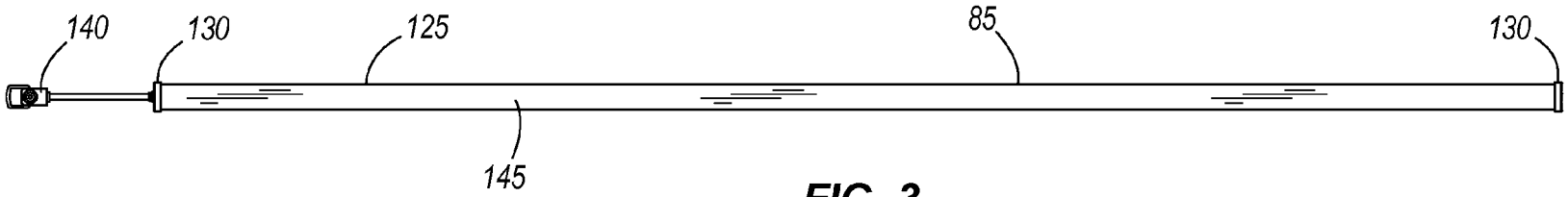
FIG. 3 is a top view of the light assembly of FIG. 2.
Figure 4:
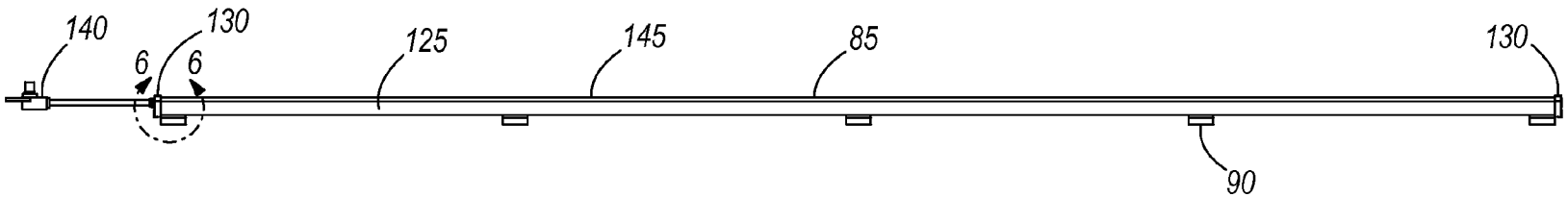
FIG. 4 is a side view of the light assembly of FIG. 2.

FIG. 1 shows a refrigerated merchandiser 10 for displaying food product (e.g., frozen food, fresh food, beverages, etc.) available to consumers in a retail setting (e.g., a supermarket or grocery store). The refrigerated merchandiser 10 includes a case 15 that has a base 20, side walls 25, a case top or canopy 30, and a rear wall 35. At least a portion of a refrigeration system (not shown) can be located within the case 15 to refrigerate the food product. The area partially enclosed by the base 20, the side walls 25, the case top 30, and the rear wall 35 defines a product display area 40. The food product is supported on shelves 45 within the product display area 40. Generally, at least a portion of the shelves 45 are constructed of a metallic material (e.g., steel). The shelves 45 may include a price tag molding (not shown) for displaying information related to the product supported on the shelf 45.

In some constructions, the case 15 includes a casing 50 adjacent a front of the merchandiser 10. FIG. 1 shows that the casing 50 includes vertical mullions 55 that define openings 60, and doors 65 positioned over the openings 60. The openings 60 and the doors 65 are configured to allow access to food product stored in the product display area 40. The mullions 55 are spaced horizontally along the case 15 to provide structural support for the case 15. Each mullion 55 is defined by a structural member that can be formed from a non-metallic or metallic material. The canopy 30, the shelves 45, an the mullion 55 define case structure of the merchandiser 10. In some constructions, the case structure can include other structural components of the merchandiser 10. A handle 70 is positioned along an edge of each door 65 to move the door 65 between an open position and a closed position.

Each door 65 includes a frame 75 that attaches a translucent member 80 to the door 65 to allow viewing of the food product from outside the case 15. The translucent member 80 can be formed from glass, or alternatively, from other materials that are substantially translucent (e.g., acrylic, etc.). In some constructions, the case 15 can include doors 65 without attachment of the doors 65 to mullions 55. In still other constructions, the case 15 can be an open-front case without the mullions 55 and doors 65.

Figure 7:
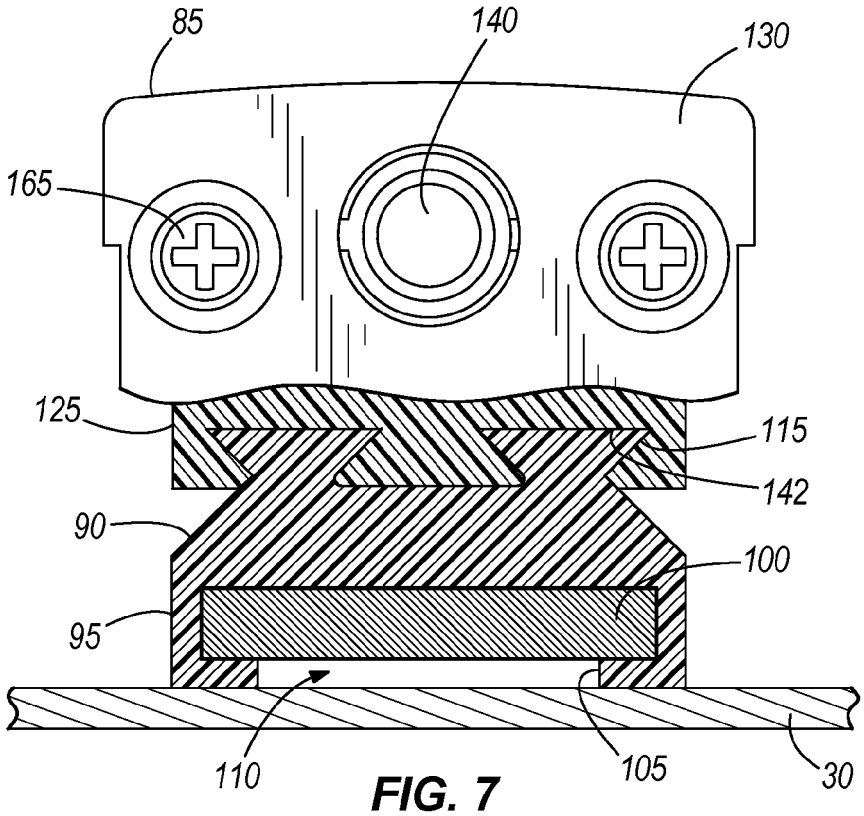
FIG. 7 is a section view of a portion of the light assembly of FIG. 6 taken along line 7-7.
Figure 8:
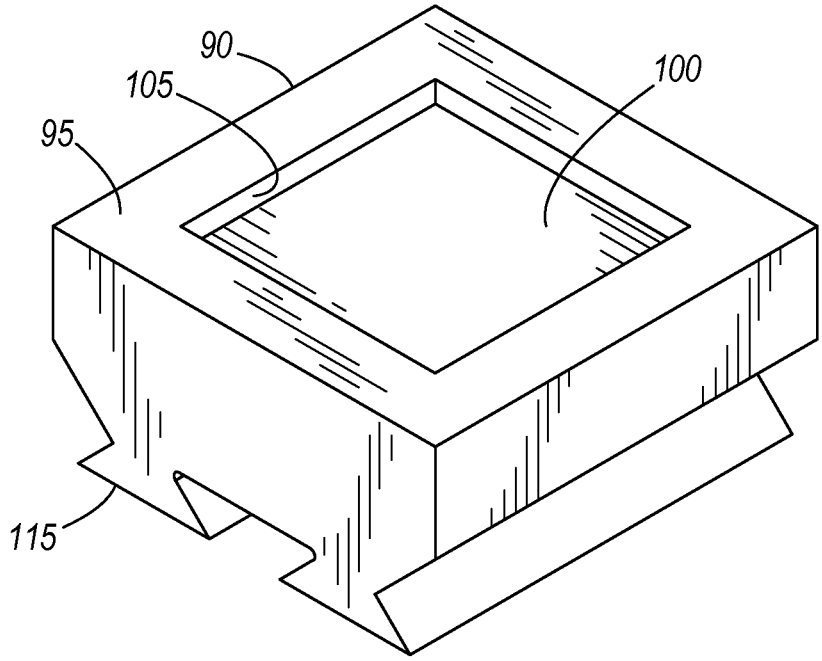
FIG. 8 is a perspective view of an attachment mechanism for the light assembly.
Figure 9:
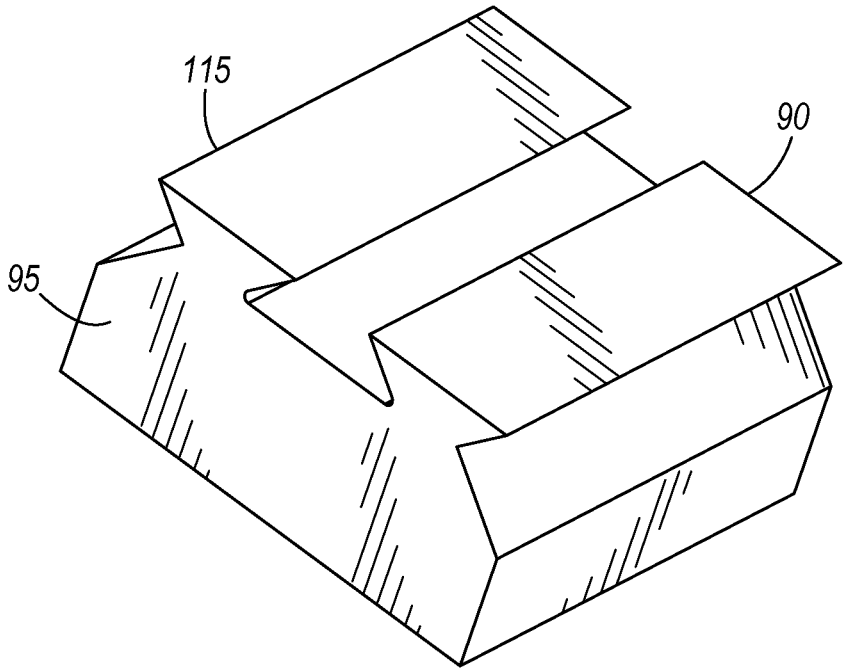
FIG. 9 is another perspective view of the attachment mechanism.

FIGS. 2-6 show a light assembly 85 that includes a plurality of attachment mechanisms 90 spaced apart from each other along the length of the light assembly 85. The attachment mechanisms 90 attach the light assembly 85 to the case structure (e.g., the canopy 30, one or more of the shelves 45, the mullions 55, etc.) for illuminating the product display area 40. As illustrated in FIGS. 7-9, the attachment mechanism 90 includes a magnet housing 95 and a magnet 100 that is substantially enclosed by the magnet housing 95. The magnet housing 95 includes an aperture 105 that exposes a portion of the magnet 100, which creates an air gap 110 between the magnet 100 and the case structure 30, 45, 55 when the light assembly 85 is coupled to the canopy 30, the shelf 45, or the mullion 55. The size of the air gap 110 depends on the case structure 30, 45, 55. If the case structure 30, 45, 55 is highly magnetic, a large air gap 110 (a tall air gap 110, as viewed in FIG. 7) can be used to facilitate attachment of the light assembly 85 to the case structure 30, 45, 55. If the case structure 30, 45, 55 is nominally magnetic, a smaller air gap 110 can be implemented to attach the light assembly 85 to the case structure 30, 45, 55. Generally, the air gap 110 can have any thickness (height, as viewed in FIG. 7) suitable for attaching the light assembly 85 to the case structure 30, 45, 55.

As illustrated, the magnet housing 95 also includes two flanged protrusions 115 that are opposite the side of the magnet housing 95 that supports the magnet 100. Alternatively, fewer or more protrusions 115 can be incorporated into the magnet housing 95. The protrusions 115 couple the magnet housing 95 to the light assembly 85. The magnet housing 95 is made from a thermally and electrically non-conductive material (e.g., composite, plastic, etc.).

Figure 5:
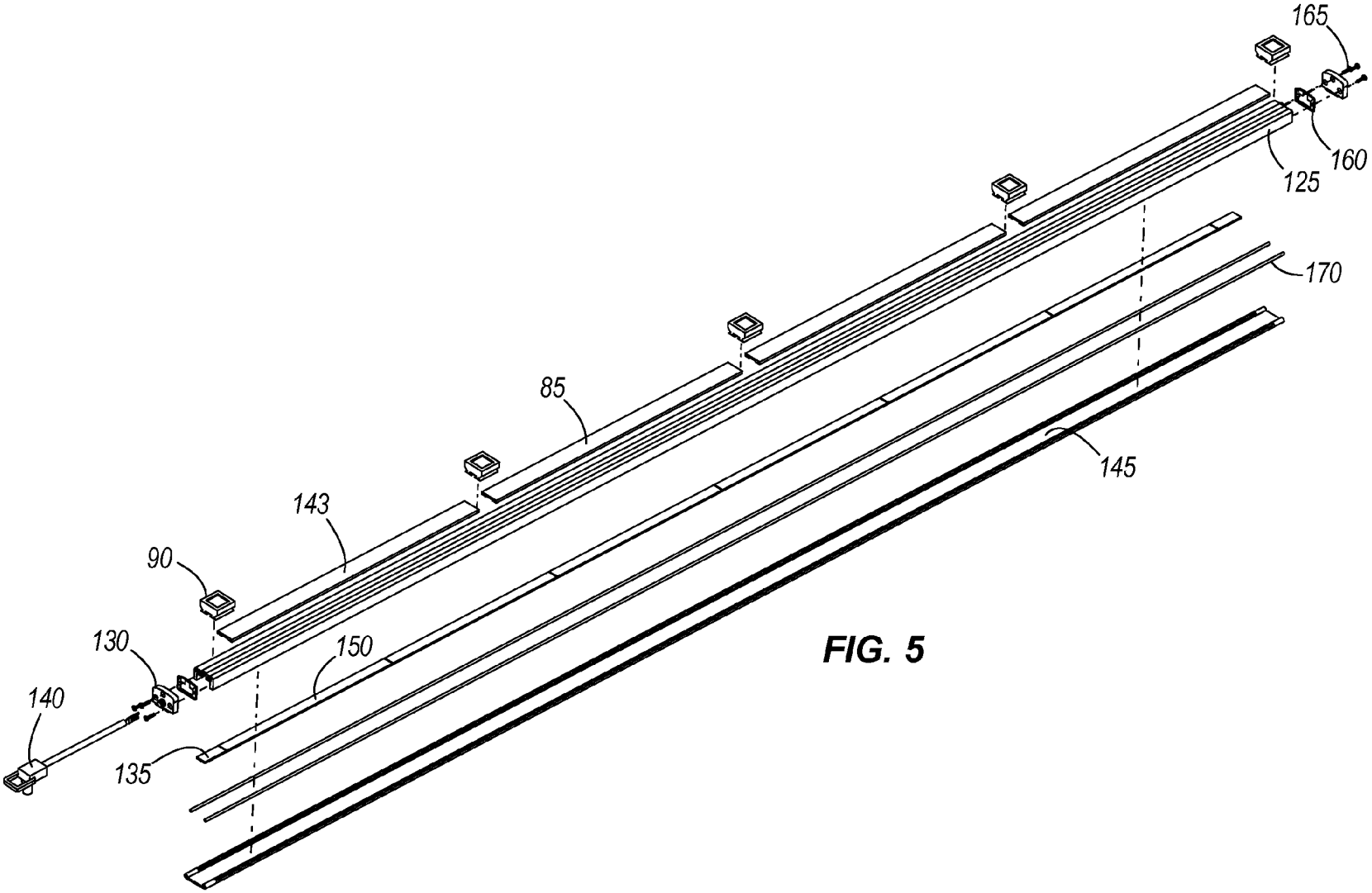
FIG. 5 is an exploded perspective view of the light assembly of FIG. 2.
Figure 6:
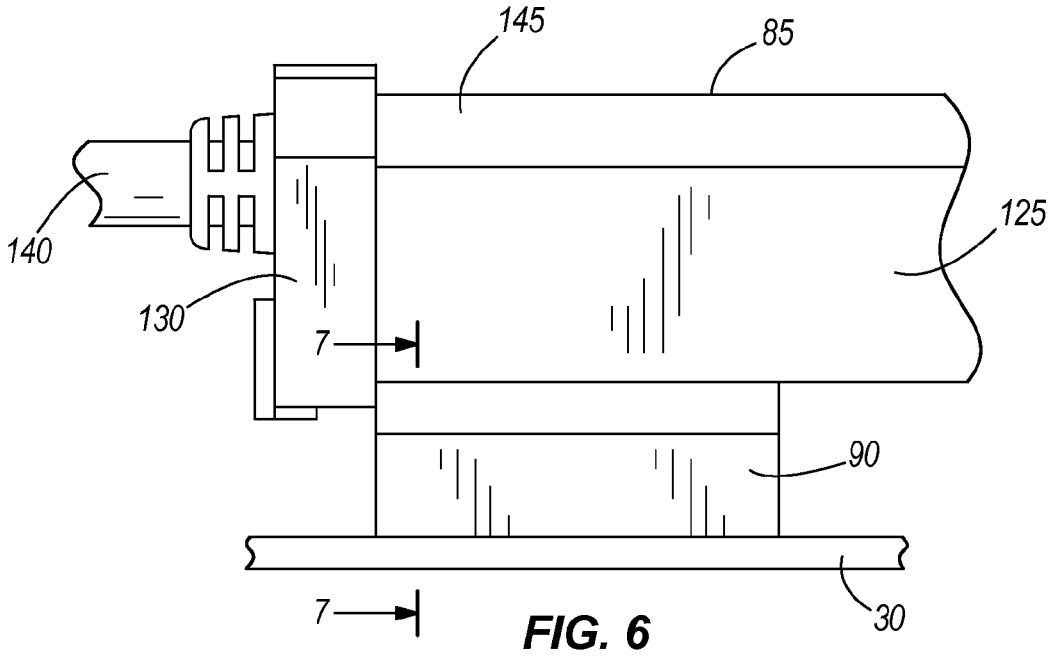
FIG. 6 is an enlarged view of a portion of the light assembly of FIG. 4 along line 6-6.

FIGS. 5 and 7 show that the light assembly 85 also includes a light housing 125, end caps 130 that are positioned on opposing ends of the light housing 125, a light source 135 coupled to the light housing 125, and a power conduit 140 for supplying power to the light assembly 85. As illustrated, the light housing 125 includes two channels 142 that receive the protrusions 115 and that are defined by a shape corresponding to the shape of the protrusions 115 so that the light assembly 85 and the attachment mechanism 90 are securely attached to each other. The protrusions 115 and the channels 142 can have any cooperative shapes that are suitable for securely attaching the light housing 125 to the attachment mechanism 90 without separate fasteners (e.g., screws, bolts, adhesive, etc.). Also, the quantity of channels 142 generally corresponds to the quantity of protrusions 115, although more channels 142 can exist on the light housing 125 than the quantity of protrusions 115 on the attachment mechanism 90.

Insulating covers 143 are coupled to the light assembly 85 between the attachment mechanisms 90 to enclose the exposed portions of the channels 142 and to space the attachment mechanisms 90 from each other. A translucent cover or lens 145 is attached to the light housing 125 to protect the light source 135 from debris or incidental contact while illuminating the product display area 40.

The light source 135 includes LED packages 150 spaced at predetermined distances along the light housing 125. For example, the LED packages 150 can be defined by an area of about 0.5 inches by 0.5 inches. Each LED package 150 can include any number of LEDs. In some constructions, each LED package 150 can include six LEDs. In other constructions, each LED package 150 may include fewer or more than six LEDs. The LEDs in each LED package 150 are low current LEDs (e.g., 15 mA), and the quantity of the LEDs are determined by the lighting necessary to illuminate the product display area 40 (FIG. 1). Alternatively, other types of light can be used (e.g., fluorescent, etc.).

The light sources 135 are generally directed at food product in the product display area 40 (FIG. 1). Each light source 135 is in electrical communication with a power supply (not shown) via the power conduit 140. The light sources 135 are coupled to circuit boards (not shown) that dissipate heat from the light sources 135, which can eliminate the need for a heat sink coupled to the light sources 135. The circuit boards are made from conventional printed circuit board material without being metal clad, and without an aluminum heat sink.

As shown in FIG. 5, insulating end cap gaskets 160 are positioned between the light housing 125 and the end caps 130, and can be attached to the light housing 125 using screws 165 or other similar fasteners. Insulating lens gaskets 170 are positioned between the light housing 125 and the translucent cover or lens 145.

The light assembly 85 can be coupled to the canopy 30, one of the shelves 45, or one of the mullions 55, or any combination thereof, to uniformly illuminate the product display area 40. Generally, one or several light assemblies 85 can be incorporated into the merchandiser 10 and attached to any suitable surface in any combination (e.g., one or more light assemblies 85 coupled to the canopy 30, one or more light assemblies 85 coupled to each shelf 45, and one or more light assemblies 85 coupled to each mullion 55) for illuminating the product display area 40. The air gap 110 limits or minimizes a high heat conductance path between the light assembly 85 and the canopy 30. Also, the non-conductive magnet housing 95 limits or minimizes electrical conductance from the case structure 30, 45, 55 to the light assembly 85, reducing the potential for shock. The attachment mechanism 90 provides relatively quick attachment of the shelf light assembly 85 to the underside of the shelf 45 without additional fasteners and without complicated work processes. As such, the light assembly 85 can be readily repositioned in the case 15 to achieve a desired level of illumination in the product display area 40.

In constructions of the merchandiser including the light assembly 85 coupled to the canopy 30, the light source 135 is directed generally downward toward the shelves 45 to illuminate a large portion of the product display area 40. The light source 135 can be oriented to focus light in any direction suitable for illuminating at least a portion of the product display area 40.

In constructions of the merchandiser including the light assembly 85 coupled to at least one shelf 45, the light assembly 85 can be substantially hidden from view (e.g., behind a price tag molding (not shown) coupled to a forward end of the shelf 45). For example, the light assembly 85 can be positioned adjacent and behind the price tag molding when viewed from outside the case 15 so that a portion of the product display area 40 can be illuminated without the light sources 135 being directly visible from outside the case 15. The light assembly 85 generally takes up a relatively small area under the shelf 45, and provides a relatively large area between the shelf 45 (to which the light assembly 85 is attached) and the shelf 45 directly above or below the light assembly 85 to provide maximum viewability of the food product stored therein.

When the light assembly 85 is coupled to the mullion 55, the light assembly 85 can be positioned so that the light sources 135 are substantially hidden from view. The light source 135 is directed generally toward the product display area 40 (e.g., toward each of the shelves 45) to illuminate a large portion of the product display area 40.

The canopy, shelf, and mullion light assemblies 85 can be used together or separately in the refrigerated merchandiser 10 to illuminate the product display area 40. Use of the low current LED packages 150 in each light assembly 85 provides substantial energy savings. Generally, the overall power required to illuminate and to refrigerate the case 15 using the LED packages 150 is lower than the power required by cases that use fluorescent light sources or high current LED light sources. The light assemblies 85 using low current LED packages 150 also can be used to replace existing fluorescent and high current LED light assemblies of existing merchandisers to provide similar illumination of the product display area 40 via more economical means.

Various features and advantages of the invention are set forth in the following claims.

The invention claimed is:

1. A merchandiser comprising:

a case defining a product display area and including case structure;

a light assembly including a light housing and a light source coupled to the light housing, the light assembly oriented to direct light generally toward the product display area; and an attachment mechanism including a magnet housing and a magnet substantially enclosed by the magnet housing, the attachment mechanism coupled to the light housing opposite the light source to attach the light assembly to the case structure such that the magnet housing contacts the case structure, a portion of the housing is positioned between the magnet and the case structure, and a portion of the magnet remains exposed to and facing the case structure.

2. The merchandiser of claim 1, wherein the case structure includes one or more of a shelf, a canopy, and a mullion of the case.

3. The merchandiser of claim 2, wherein the shelf includes a forward end and the light assembly is positioned adjacent the forward end and substantially hidden from view.

4. The merchandiser of claim 1, wherein the light source includes a plurality of LED packages having one or more low current LEDs.

5. The merchandiser of claim 1, wherein the light housing defines a channel, and wherein the attachment mechanism is attached to the light housing within the channel.

6. The merchandiser of claim 1, wherein the magnet is spaced apart from the case structure by the magnet housing.

7. The merchandiser of claim 6, wherein the magnet housing is thermally non-conductive.

8. The merchandiser of claim 6, wherein the magnet housing includes a composite.

9. The merchandiser of claim 6, wherein the magnet housing includes an aperture exposing a portion of the magnet adjacent the case structure.

10. The merchandiser of claim 9, wherein the aperture defines an insulating air gap between the magnet and the case structure.

11. A light assembly for a merchandiser including case structure, the light assembly comprising:

a light housing;

a light source coupled to the light housing; and an attachment mechanism including a magnet housing and a magnet substantially enclosed by the magnet housing, the attachment mechanism coupled to the light housing opposite the light source and configured to couple to the case structure such that a portion of the housing is positioned between the magnet and the case structure and the magnet is spaced from the case structure, and a portion of the magnet remains exposed to and facing the case structure.

12. The light assembly of claim 11, wherein the magnet housing is a non-conductive housing having an aperture exposing a portion of the magnet to the case structure when the light assembly is coupled to the case structure.

13. The light assembly of claim 12, wherein the aperture defines an insulating air gap between the magnet and the case structure when the light assembly is coupled to the case structure.

14. The light assembly of claim 12, wherein the magnet housing includes at least one of a composite and a plastic.

15. The light assembly of claim 12, wherein the magnet housing is at least one of electrically non-conductive and thermally non-conductive.

16. The light assembly of claim 11, wherein the light source includes a plurality of LED packages having one or more low current LEDs.

17. The light assembly of claim 11, wherein the light housing defines a channel, and wherein the magnet housing includes a protrusion that is received by the channel of the light housing.

18. A light assembly for a merchandiser including case structure, the light assembly comprising:

a light housing;

an LED light source coupled to the light housing; and an attachment mechanism including a non-conductive housing defining an aperture and a magnet partially exposed by the aperture, the attachment mechanism coupled to the light housing opposite the LED light source and configured to couple to the case structure such that the magnet is spaced apart from the case structure, wherein a portion of the non-conductive housing is positioned between the magnet and the case structure and the magnet remains exposed to the case structure via the aperture.

19. The light assembly of claim 18, wherein the aperture defines an insulating air gap between the magnet and the case structure when the light assembly is coupled to the case structure.

20. The light assembly of claim 18, wherein the magnet housing is a non-conductive housing.

* * * * *